United States Patent [19]

Yoder

[11] Patent Number: 4,467,563

[45] Date of Patent: Aug. 28, 1984

[54] VIBRATORY FINISHING APPARATUS

[75] Inventor: Ronald L. Yoder, Topeka, Ind.

[73] Assignee: Universal Consolidated Methods, Inc., Topeka, Ind.

[21] Appl. No.: 336,457

[22] Filed: Dec. 31, 1981

[51] Int. Cl.[3] ..... B24B 31/06

[52] U.S. Cl. ..... 51/163.1; 51/7

[58] Field of Search ..... 51/7, 163.1, 163.2, 51/164

[56] References Cited

U.S. PATENT DOCUMENTS

| | | | |
|---|---|---|---|
| 2,143,610 | 1/1939 | Muller | 51/163.1 |
| 2,208,077 | 7/1940 | Linke | 51/7 |
| 2,222,776 | 11/1940 | Linke et al. | 51/163.1 |
| 2,222,777 | 11/1940 | Linke | 51/7 |
| 2,389,337 | 11/1945 | Zademach | 51/163.1 |
| 3,045,397 | 7/1962 | Hesslenberg | 51/7 |
| 3,071,900 | 1/1963 | Balz | 51/163.1 |
| 3,253,369 | 5/1966 | Rerchert | 51/163.1 |
| 3,624,970 | 12/1971 | Balz | 51/163.1 |
| 3,680,266 | 8/1972 | Shiplou | 51/163.1 |
| 4,059,926 | 11/1977 | Rampe | 51/163.1 |

FOREIGN PATENT DOCUMENTS

| | | | |
|---|---|---|---|
| 627951 | 10/1978 | U.S.S.R. | 51/7 |

*Primary Examiner*—Harold D. Whitehead

*Attorney, Agent, or Firm*—George A. Gust

[57] ABSTRACT

Vibratory finishing apparatus comprises an elongated container having an open top. The container is disposed with its longitudinal axis horizontal and is divided into a plurality of individual compartments arranged in tandem. A plurality of drain orifices are provided in the bottom of such compartments whereby the flow of fluid and particulate matter is through each of said compartments individually from the top to the bottom thereof. Means are provided for vibrating the container and its compartments in unison. Minute vibratory motion between metallic parts and medium within such compartments and the futher enmasse orbital movement of such mass about a common longitudinal axis are utilized to finish and in some instances polish such parts.

10 Claims, 12 Drawing Figures

VIBRATORY FINISHING APPARATUS

BACKGROUND OF THE INVENTION

1. Field of the Invention

The present invention relates to the finishing and polishing of metallic parts and more particularly to improvements in apparatus for performing such finishing and polishing.

2. Description of the Prior Art

Typical of the art of finishing apparatus are the following U.S. Pat. Nos.: Re. 27,084; 2,882,024; 3,093,940; 3,100,088; 3,103,086; 3,161,997; 3,400,495; 3,423,884; 3,435,564; 3,466,815; 3,624,970; 3,871,135 and 3,893,266. In carrying out finishing or polishing of metallic parts, a finishing or polishing machine has been employed which includes a tub or container with a semicylindrical bottom. Such tub configurations are disclosed in certain of the above patents, including U.S. Pat. Nos. 3,093,940; 3,103,086; 3,161,997; 3,423,884; 3,435,564 and 3,624,970. Mounted directly on the tub has been a vibrator comprising an electric motor driving an eccentric weight which rotates on an axis usually parallel to the axis of the semi-cylindrical bottom of the tub. The tub and the vibrator are supported as a unit for independent movement in space on suitable spring mountings. The parts to be finished are placed in the tub along with abrasive media such as stone chips, steel balls or the like. Steel balls are generally used for polishing.

When the vibrator is actuated, the mass of polishing medium and the parts are vibrated with the result that there is minute vibratory motion between the parts and the polishing medium and the further enmasse orbital movement of the mass about an axis extending generally parallel to the axis of the semi-cylindrical bottom of the tub.

It is conventional to employ a liquid finishing compound which is added to the mass. Examples of such finishing compounds includes detergents, soaps, surfactants, wetting agents and the like, typical of these being disclosed in the aforesaid U.S. Pat. No. 3,161,997. Such tubs are usually provided with means for draining off such liquid compounds as well as particulate matter in the form of fines or sediment coming either from the parts or the finishing medium present in the mass.

The aforesaid tubs are for the most part in single, compartmental form, especially those which are elongated. Those which conform more to cup or barrel shapes and are vibrated generally about an upright axis are in some instances compartmented.

SUMMARY OF THE INVENTION

In this invention, the finishing apparatus includes an elongated container having an open top, the container being disposed with its longitudinal axis generally horizontal. A number of partitions are provided within the container for dividing it into a plurality of individual compartments tandemly arranged. A multiplicity of drain orifices are provided in the bottom of all of such compartments whereby flow of fluid and particulate matter is through each compartment from the top to the bottom thereof. Means are provided for vibrating the container and its compartments in unison.

In a preferred embodiment, the container and compartments are part cylindrical about the longitudinal axis with the vibrating means imparting a vibratory motion to the container which causes finishing material and parts within the compartments to rotate generally about such axis. The part-cylindrical shape is greater than a half cylinder with the transverse dimension of the open top being less than the maximum transverse dimension or diameter of such part-cylindrical shape. Preferably, the internal surfaces of the compartments are covered with a resilient, cushioning elastomeric material.

In order to produce uniform vibration of the container and all of the compartments therein, the container is rigidly mounted upon a supporting frame which in turn is resiliently supported on a stationary platform. The vibrating means includes a shaft journalled for rotation within bearings mounted on the supporting frame, the shaft extending parallel to the axis of the container and in a location therebeneath. Eccentric weights are mounted on the shaft and a driving motor on the frame. Rotation of the shaft causes vibration of the frame as well as the container in unison.

In operation, a minimum amount of finishing medium is required, damage due to the parts contacting each other is minimized or entirely eliminated, and consistent finishing of a relatively large number of parts is achieved in a reliable, efficient manner.

It is an object of this invention to provide for improvements in the finishing or polishing of metallic parts.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
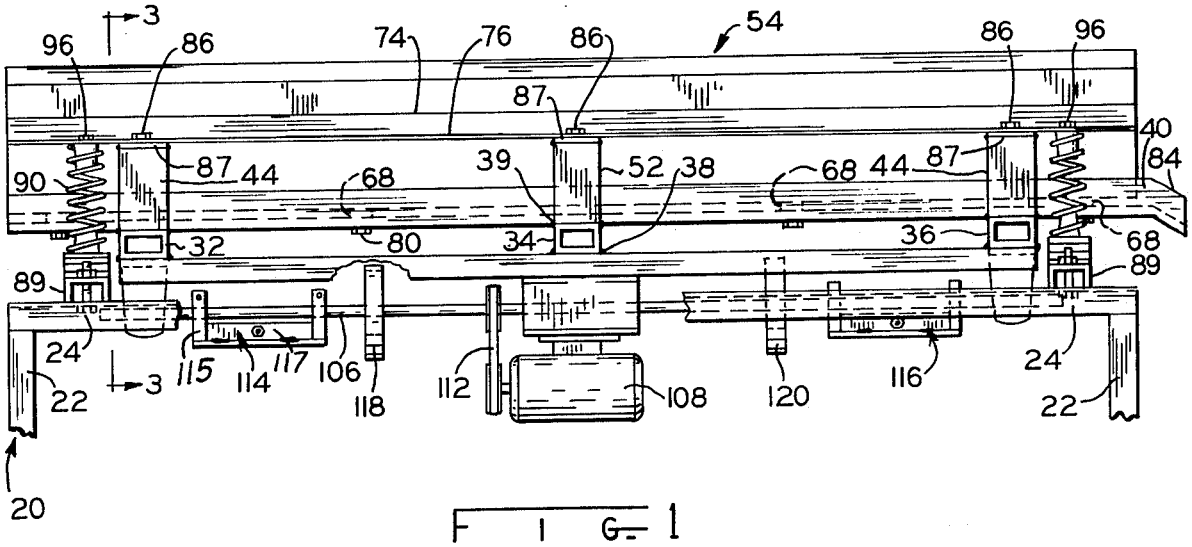
FIG. 1 is a side view of one embodiment of this invention.
Figure 2:
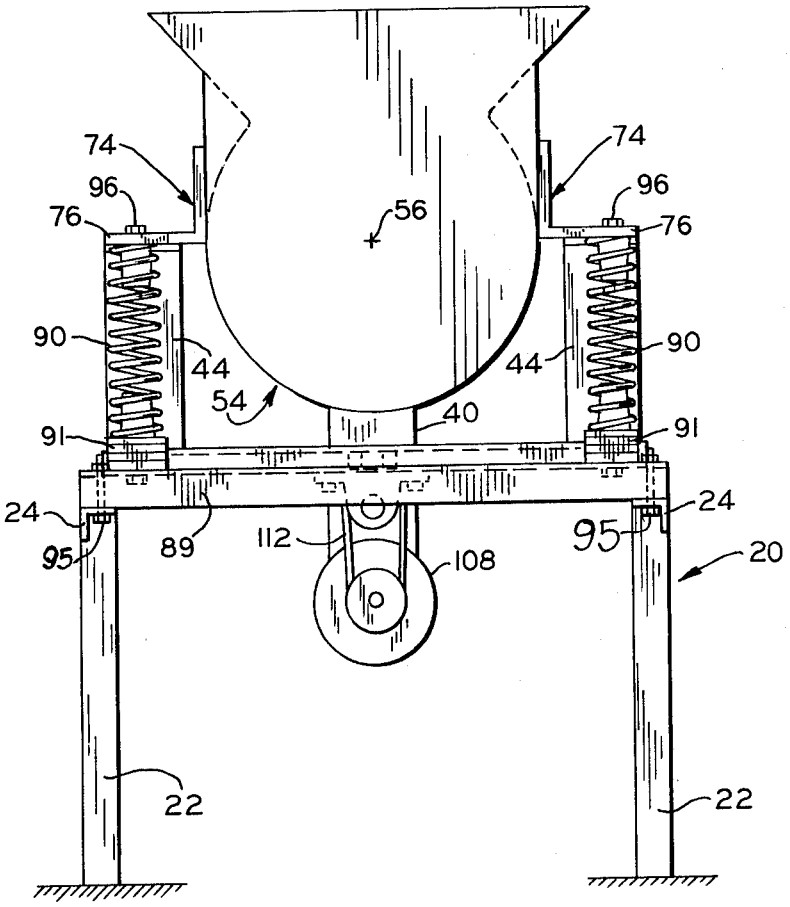
FIG. 2 is an end view thereof.
Figure 3:
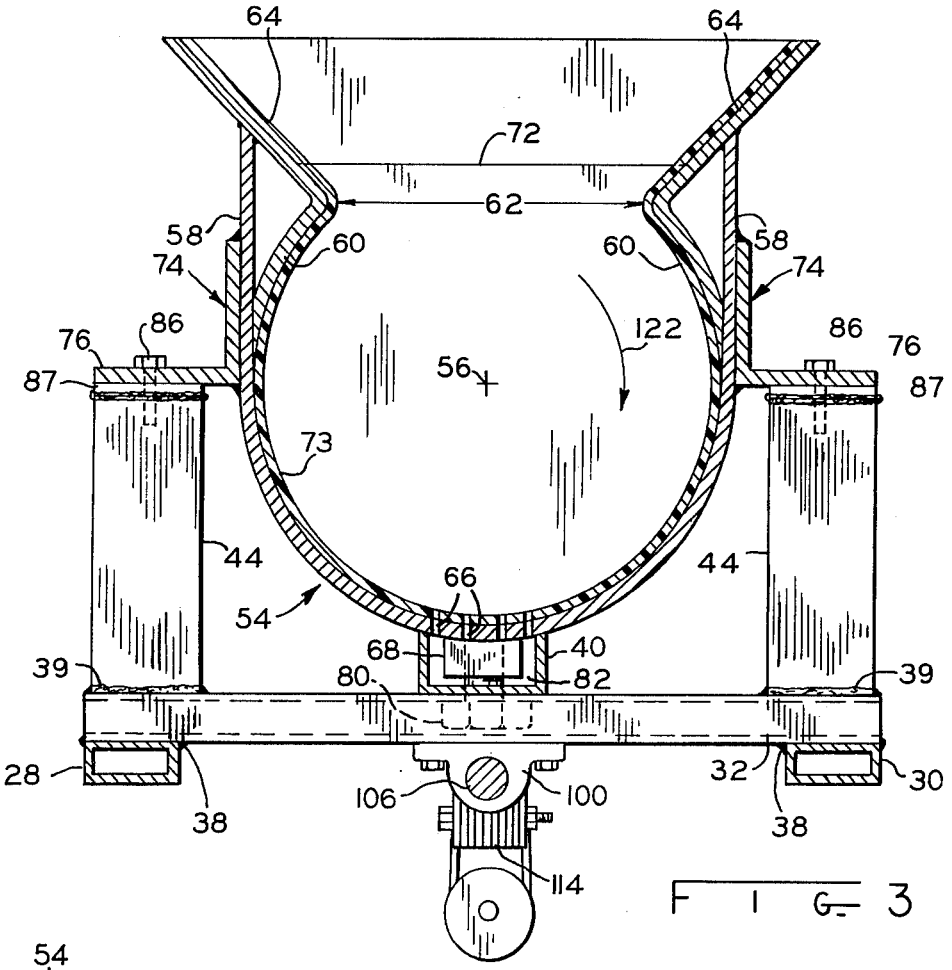
FIG. 3 is a cross section taken substantially along section line 3—3 of FIG. 1.

Referring to the drawings, and more particularly to FIGS. 1 through 3, a rigid, stationary supporting platform or frame is indicated by the numeral 20. This platform includes supporting legs 22, elongated, horizontal girders 24, and elongated cross members 26 welded thereto at the ends. The remainder of the structure which is the vibrating portion thereof is resiliently mounted on the platform 20.

Figure 4:
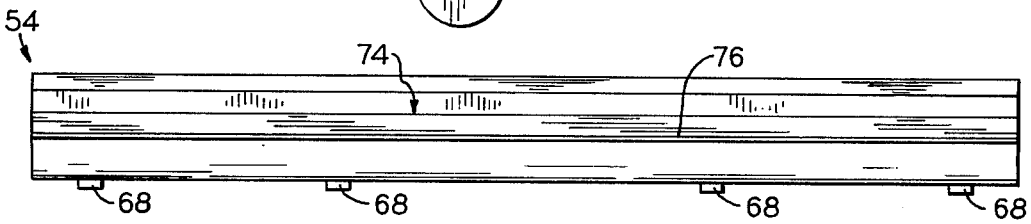
FIGS. 4, 5 and 6 are side, top and bottom views of the elongated container illustrated in the preceding figures.
Figure 5:
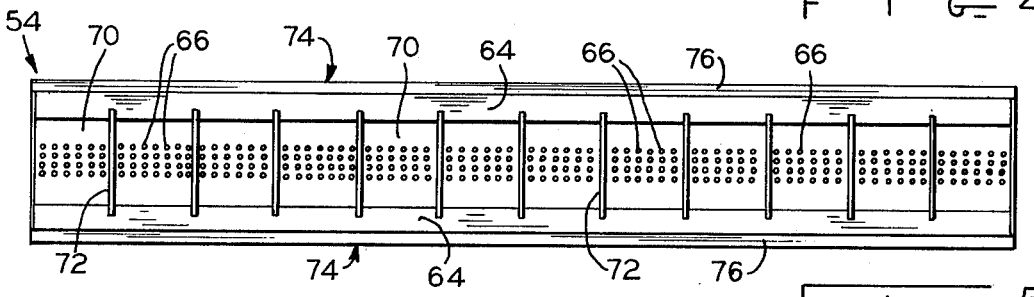
Figure 6:
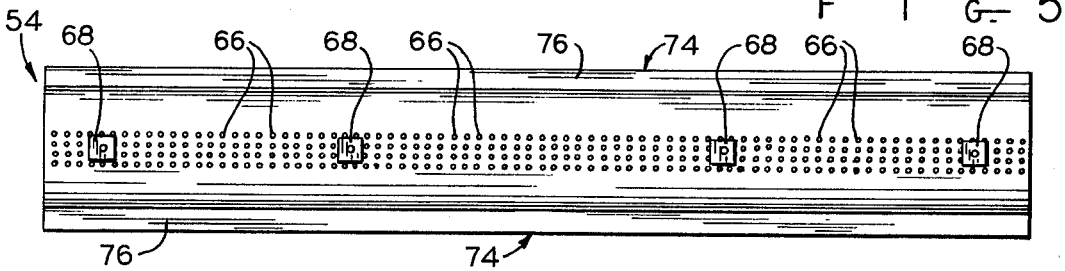
Figure 7:
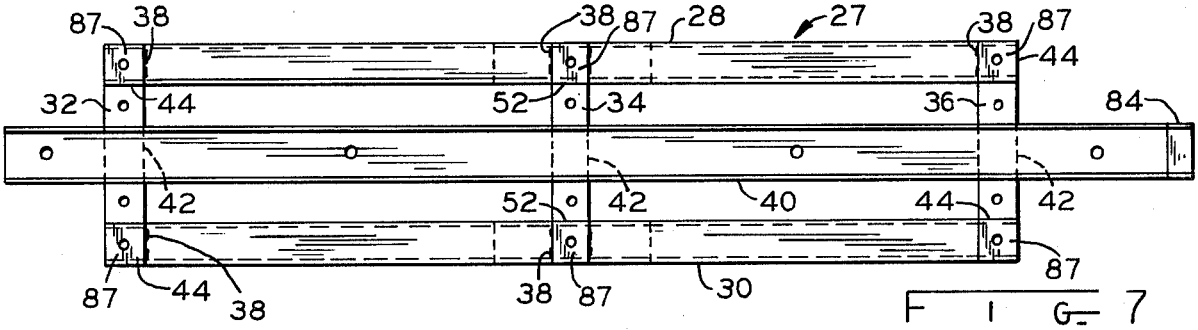
FIGS. 7 and 8 are top and side views, respectively, of the carriage frame upon which the container of FIGS. 4, 5 and 6 is mounted.
Figure 8:
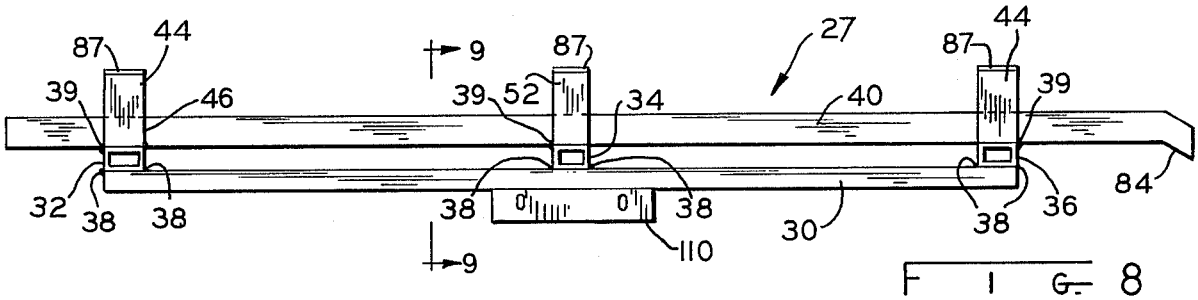
Figure 10:
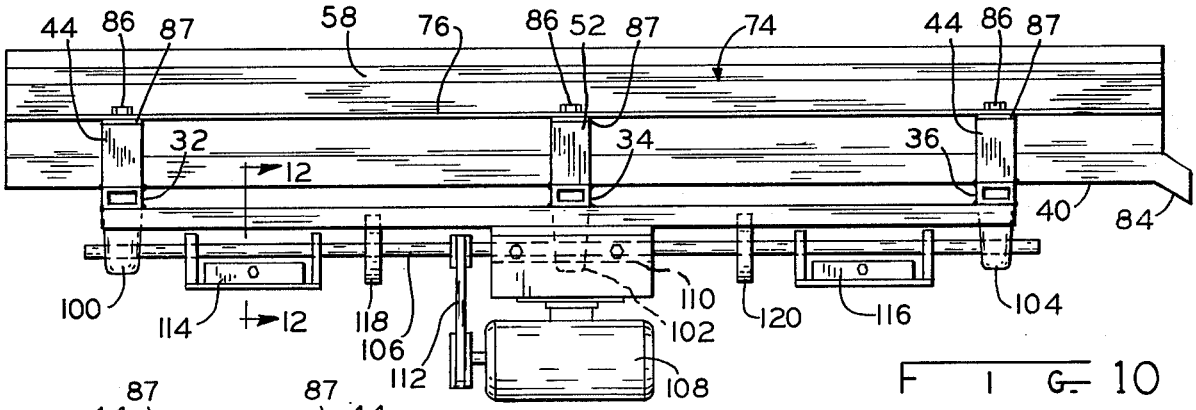
FIG. 10 is a side view of the container of FIGS. 4 through 6, as mounted on the carriage frame of FIGS. 7 and 8 and with the rotary eccentric weight mechanism mounted thereon.
Figure 9:
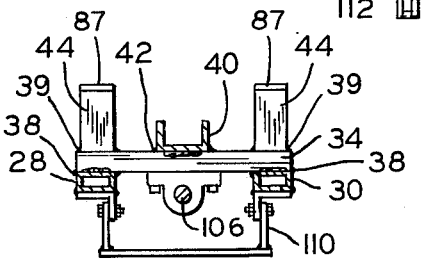
FIG. 9 is a cross section taken substantially along section line 9—9 of FIG. 8 illustrating the mount for the electric motor used to impart rotation to the eccentric-weight shaft of the apparatus shown in FIG. 1.

This remaining structure may be considered as three subassemblies, the first being the carriage frame of FIGS. 7 and 8, the elongated container of FIGS. 4 through 6, and the rotary, eccentric weight mechanism as shown in FIGS. 1, 2 and 10. Referring first to FIGS. 7 and 8, the carriage frame generally indicated by the numeral 27 includes two lengths 28 and 30 of box-shaped iron which are spaced apart and parallel as shown. These are rigidly secured together by means of three cross members 32, 34 and 36, box-shaped in cross-section, by means of weldments 38. Another longer channel iron 40 is superposed on the three cross members 32, 34 and 36 midway between the two frame members 28 and 30 and in parallelism therewith as shown. This channel 40 is secured to the cross members by means of weldments 42.

Two pairs of upstanding posts 44 are secured to the opposite ends, respectively, of carriage frame 27, these posts 44 being welded to cross members 32 and 36 at the bases as indicated by numeral 39. Two additional upright posts 52 are welded to the opposite ends of the cross member 34 as shown, these being essentially the same as the posts 44.

The container portion of this invention will now be described, reference in particular being had to FIGS. 3 through 6. The container, closed at both ends, is indicated by the numeral 54 and as clearly shown in FIG. 3 is part cylindrical in cross section, the numeral 56 indicating the longitudinal axis thereof. This axis 56 is normally disposed horizontally as otherwise shown in FIG. 1. The container 54 is formed to a U-shape of sheet metal, having opposite sides 58 which are generally parallel. Elongated bars, which may be in the form of angle irons, indicated by the numeral 60, are welded to the upper portions of the sides 58 as shown in FIG. 3 thereby to serve as part-cylindrical extensions of the cylindrical bottom portion of the container 54. These part-cylindrical extensions 60 together with the bottom half of the container 54 provide a part-cylindrical shape which is greater than a half cylinder, resulting in an open container top having a transverse dimension 62 which is smaller than the largest transverse dimension or diameter of the container 54. The portion of the container above the opening 62 is straight and angled as indicated by the numeral 64, all of the parts being welded together as to provide a single, integrated assembly.

The bottom of the container 54 is provided with a multiplicity of drain orifices 66 which extend from end-to-end thereof. To the underneath side of the container 54 are welded four internally threaded nut elements 68 (FIG. 4) for a purpose later to be explained. The container is divided into a plurality of like compartments 70 by means of transverse partitions 72, these partitions being welded to the interior surfaces of the container 54. The compartments 70 are preferably of the same size and small enough as to prevent part-on-part damage as will be explained in more detail later.

The interiors of the compartments 70 and partitions 72 are lined or covered with a suitable resilient, cushioning elastomer 73. This elastomer may be either in the form of cured liquid rubber, polyurethane or the like. Such layer 73 should be relatively firm but rather easily indented with a fingernail. It is intended to serve as a cushion and liner for preventing contact of the polishing media and parts with the bare metal surfaces of the compartments 70.

To the opposite sides of the container 54 and extending in parallelism therewith are welded two angle irons 74 at a location at which the horizontal flanges are coplanar horizontally with axis 56.

Referring now to FIGS. 1, 3, 10 and 11, the container 54 is rigidly secured to the carriage frame 127. First, the container 54 is aligned to be parallel with the frame 27 and is superposed thereon by the engagement of the underneath side of the container 54 with the open side of the channel member 40. Threaded fasteners such as bolts 80 secure the channel 40 to the container 54 by being threaded into the nut members 68. This then forms a duct 82 closed at the left end as viewed in FIG. 1 but open at the right end 84 to provide a drain. As shown clearly in FIG. 3, all of the orifices 66 are in registry with the duct 82 so that any liquid or particulate matter within the container 54 may pass through the orifices 66 into the duct 82. It will be observed that the bolts 80 also serve in partially securing the carriage frame 27 to the container 54. Further securement is provided by attaching the upper ends of the posts 44 and 52 to the opposite sides of the container 54 by means of threaded fasteners 86 received through openings in the horizontal flange 76 of angle irons 74. Fasteners 86 are threaded into plates 87 flat welded to the tops of posts 44 and 52. The container 54 and carriage frame 27 are now rigidly secured together as a unitary assembly.

Figure 11:
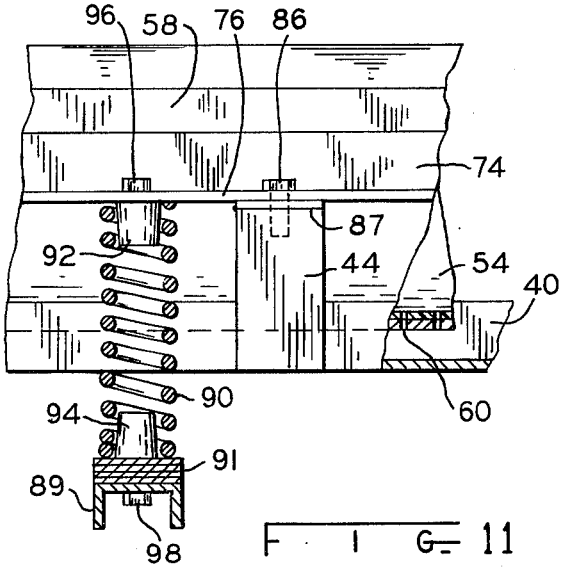
FIG. 11 is a fragmentary side view of that portion of FIG. 1 showing the construction of the mounting springs and the fluid-collecting channel which is clamped to the bottom of the elongated container.

This unitary assembly is spring-mounted on the platform 20 as shown more clearly in FIGS. 1, 2 and 11. Likewise, upright helical compression springs 90 are interposed between the flanges 76 and the cross bars 89 bolted to platform 20 to carry the full weight of the container-frame assembly. These springs 90 are held in place by means of cylindrical retaining pins 92 and 94 secured to the flanges 76 and cross members, respectively, by means of threaded fasteners 96 and 98. These retaining pins 92 and 94 are cylindrical and have a sliding telescoping fit with the springs 90. Cross members 89 are channels secured at the ends thereof by bolts 95. Shims 91 as needed are interposed between the pins 94, bottoms of springs 90 and cross members 89 (see FIG. 11). Since all of the springs 90 are of the same size and have the same load-carrying strength, the container 54 will be held in horizontal position assuming, of course, that the supporting frame 20 is also horizontal. As shown in FIG. 2, the springs 90 on opposite sides of the container 54 are spaced as close to the container 54 as possible and furthermore have the upper ends thereof disposed about horizontally even with the axis 56.

The mechanism for vibrating the container 54 and frame 27 as a unit relative to the stationary frame 20 is shown more clearly in FIGS. 1, 2, 9 and 10. Three bearings 100, 102 and 104 are secured to the undersides of the cross members 32, 34 and 36, respectively, as shown. These bearings have journalled therein a shaft 106, the bearings being suitably set to dispose the shaft 106 parallel and vertically below the axis 56 of the container 54. An electric motor 108 is carried by and depends from the carriage frame 27 by means of a suitable box-shaped platform 110 secured to the undersides of the two members 28 and 30 by means of threaded fasteners. The motor 108 is drivingly connected to the shaft 106 by means of a belt and pulley arrangement 112. As is shown in FIGS. 1 and 10, the motor 108 is centered with respect to the frame 27 and container 54.

On the shaft 106 are mounted two eccentric weights 114 and 116, each of the weights being composed of a carrier 115 and a plurality of metal plates 117 laminated and clamped together by means of a threaded fastener. The number of plates may be varied to vary the mass of the weights. Generally speaking, the weights 114 and 116 are the same and are symmetrically positioned on the shaft 106 relative to the container 54. As shown in the drawings, the weights 114 are located nearer the end bearings 100 and 104, respectively, than they are to the center bearing 102. Inboard of the weights 114 and 116 are two flywheels secured to shaft 106. Energization of the motor 108 rotates the eccentric weight assembly which includes the shaft 106, the eccentric weights 114, 116 and the flywheels 118, 120.

The pieces and parts of the apparatus are so sized and arranged that upon energization of the motor 108, the container 54 and carriage frame 27 are vibrated as a unit such that finishing material and parts within the container 54 is given a rotary or orbital movement clockwise about the axis 56 as indicated by the arrow 122 in FIG. 3. Such orbital movement in similar apparatuses is conventional. For one working embodiment, a suitable speed of rotation for the shaft 106 is 1300 rpm.

In use, all of the compartments 70 are charged with suitable finishing material, such as steel balls. Such balls are filled to a level slightly below that of the opening 62 (FIG. 3). Parts to be polished, such as brass or aluminum are placed in the individual compartments 70, the number being limited by trial and error to allow for a maximum number of parts as will not produce part-on-part damage due to interpart impingement. Such number of parts may be increased from batch to batch, with the resultant finish being observed at the end of each polishing operation. Should an excessive number be processed, the resultant finish will be inferior than in processing a fewer number.

In a working embodiment, it has been found that about 20 pounds of steel balls in a single compartment 70 performs a satisfactory polishing action.

Once the motor 108 is energized, the container will be vibrated such that the finishing medium and parts will enmasse be rotated about the axis 56. By reason of the gentle rolling and vibratory rubbing motion, fines and sediment may be developed from both the steel balls and the parts being polished. Unless these are removed, both the media and parts will become dirty or contaminated which detracts from the appearance of the polish on the parts. This problem is overcome by using a suitable cleaning compound, such as a detergent, soap, surfactant, wetting agent and the like. A small quantity of such material is poured into each of the compartments 70 while the apparatus is operating. This material will filter down through the media and parts and will eventually drain through the orifices 66 into the collecting duct 82. From the collecting duct, this drainage will empty from the end 84 of the channel 40. Trial and error is again employed for the purpose of optimizing the amount of such cleaning compound used. Too little or too much such compound can result in an undesired finish. Adding a small quantity about twice an hour is all that is required in one working embodiment.

Since each compartment 70 has its individual drain orifices 66, it is seen that such liquid cleaning material, fines and sediment will be scavenged from each compartment thereby maximizing the cleaning action. If orifices 66 were provided in only one end of the container 54, for example in the right end, the cleaning compound as well as the fines and sediment would have to travel from the opposite end portions of the container all the way through the media and parts. The net result would be that the media and parts at the right hand end would have circulated therethrough the dirty or contaminated materials from the other end such that a uniform, consistent polishing action could not be obtained.

By reason of the partitions 72, the parts of one compartment are prevented from co-mingling with parts in another. If the partitions 72 were absent, the parts would tend to collect in localized regions, circulate and impinge each other to an extent as could cause damage. By providing the partitions, the parts are maintained separated thereby resulting in optimum polishing action of a uniform, consistent nature in each individual compartment. For this reason, more parts may be polished in a single batch within the container 54 than otherwise would be possible.

As explained earlier, the interior surfaces of the container 54 and partitions 72 are coated with a suitable resilient, cushioning elastomer thereby to prevent the parts and media from contacting the metallic surfaces of the container 54. Such an elastomer may be in the form of solidified liquid rubber, polyurethane or the like. The resilience and friction presented by the elastomer works in conjunction with the media and parts thereby to prevent parts damage and furthermore to promote rolling and circulation which will assure uniform polishing action. Given in the following are demensions and parameters of a typical working embodiment of this invention, these being exemplary only and not limitative of the invention. The scope of the invention is given in the claims appended hereto.

| | |
|---|---|
| Container 54, outside diameter | 6½" |
| Radius of container 54 | 3¼" |
| Height of sides 58 between the bottom of container 54 to the divergent flanges 64 | 6½" |
| Height of container 54 | 7½" |
| Length of container 54 | 60" |
| Length of compartments 70 (between partitions 72) | 5" |
| Location of posts 44 from opposite ends of container 54 | 7" |
| Location of four female nut elements 68 from one end of container 54 | 3", 18½", 4½", 57" |
| Length of elements 28, 30 (same as longitudinal distance between posts 44) | 48" |
| Spacing between elements 28 and 30, center line to center line (also spaces between centers of springs 90) | 9⅛" |
| Distance between center line of posts 44 and adjacent springs 90 | 2⅝" |
| Height of posts 44 and 52 | 5" |
| Width of posts 44 and 52 | 5" |
| Outer diameter of retaining pins 92, 94 | 1⅛" |
| Length of retaining pins 92, 94 | 1¼" |
| Length of springs 90 | 5" |
| Inner diameter of springs 90 | 1⅛" |
| Outer diameter of springs 90 | 1⅝" |
| Pitch of springs 90 | 2 turns per inch |
| Outer Diameter of wire in springs 90 | ¼" |
| Distance between center of shaft 106 and bottom of container 54 | 4⅛" |
| Outside diameter of shaft 106 | 1¼" |
| Shaft 106 material | Cold rolled steel |
| Location of weights 114, 116 on shaft 106 from vertical line through end fasteners 86 to weights 114, 116, respectively | 2" |
| Length of each carrier 115 | 8" |
| Distance from axis of shaft 106 and outer extremity of weight 114, 116 | 2⅝" |
| Mass of the plates 117 and carrier 115 of each weight 114, 116 | 9 lbs. |
| Outside diameter of each flywheel 118, 120 | 5" |

-continued

| | |
|---|---|
| Width of each flywheel 118, 120 | 1" |
| Weight of each flywheel 118, 120 | 5 lbs. 3 oz. |
| Location of each flywheel from center bearing 102 | 8" |
| Speed of shaft 106 | 1300 rpm. |
| Rating of motor 108 | 1 hp. |

Figure 12:
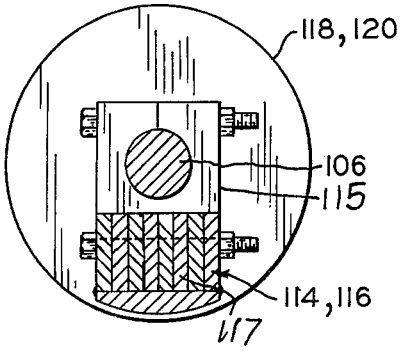
FIG. 12 is a cross section of an eccentric weight and taken substantially along section line 12—12 of FIG. 10.

The mass of weights 114, 116 may be adjusted by varying the number of plates (FIG. 12) in order to obtain an adjustment of the vibratory characteristic.

While there have been described above the principles of this invention in connection with specific apparatus, it is to be clearly understood that this description is made only by way of example and not as a limitation to the scope of the invention.

What is claimed is:

1. Finishing apparatus comprising an elongated container having an open top, said container being disposed with its longitudinal axis horizontal, means comprising a plurality of spaced generally flat partitions for dividing said container into a plurality of individual compartments arranged in tandem from end-to-end thereof, said container and compartments being part-cylindrical about said axis, with the part-cylindrical shape being greater than a half cylinder with the transverse dimension of said open top being less than the maximum transverse dimension of the cylinder, a plurality of drain orifices in the bottoms of said compartments whereby the flow of fluid and particulate matter is through said compartments individually from top to bottom, and means including means for mounting said container on a stationary support for substantially free movement in space having an elongated carriage frame to which said container is secured in parallelism, said mounting means including a plurality of upright helical compression springs interposed between said frame and support to support the load of said container, a shaft mounted on said frame for rotation about an axis parallel to said longitudinal axis including at least one eccentric weight and at least one fly wheel on said shaft for vibrating said container and its compartments so as to subject each compartment to substantially the same motion, a single elongated fluid-collecting channel shaped member secured beneath the underside of said container with the open side thereof positioned to collect drainage from said compartments simultaneously, said channel-shaped member being a secured part of said carriage frame.

2. The apparatus of claim 1 wherein the internal surfaces of said compartments are lined with a resilient elastomeric material.

3. The apparatus of claim 1 wherein said vibrating means further includes an electric motor on said frame having a belt drive with said shaft, said shaft being journaled within three spaced bearings which are secured to and depend beneath said frame and said container, two of said bearings being near the ends, respectively, of said container and the third being near the center, there being two such weights and flywheels on said shaft on opposite sides, respectively, of said third bearing.

4. The apparatus of claim 1 wherein said channel member is secured to said container to form with the underside thereof and an elongated enclosed duct for draining away the contents of said compartments.

5. The apparatus of claim 4 wherein said carriage frame includes two spaced parallel elongated frame elements disposed immediately adjacent to the opposite sides of said container in parallelism therewith, two pairs of upstanding posts secured at the upper ends to the outer sides of said container adjacent to the opposite ends thereof, respectively, and at the lower ends to the end portions of said frame elements thereby rigidly securing said carriage frame to said container.

6. The apparatus of claim 5 wherein said carriage frame is mounted on said stationary support by means of four upstanding helical compression springs interposed in load-bearing relation between flanges on said container, respectively, and said stationary support, said springs being disposed immediately adjacent to the lateral sides of said container.

7. The apparatus of claim 6 wherein said posts at the upper ends are secured to said flanges, respectively.

8. The apparatus of claim 7 wherein said carriage frame further includes two transverse frame members adjacent to the opposite ends, respectively, of said container, said transverse frame members being secured at the opposite ends thereof to said elongated frame elements, said posts being directly secured at at the lower ends thereof to said transverse frame members, respectively, and said channel member also being secured to said transverse frame members.

9. The apparatus of claim 7 wherein said springs at the upper ends are telescoped over retaining pins secured to and depending from said flanges, respectively, said springs at the lower ends also being telescoped over other retaining pins secured to and upstanding from said stationary support.

10. The apparatus of claim 8 wherein said vibrating means includes bearings mounted on said transverse members which receive for rotation a shaft disposed beneath said carriage frame and container and extending parallel to the longitudinal axis of said container, said shaft carrying eccentric weights and flywheels, and an electric motor secured to and depending from said carriage frame beneath said shaft and being drivingly connected to said shaft.

* * * * *